US009482005B2

(12) United States Patent
Mizoguchi et al.

(10) Patent No.: US 9,482,005 B2
(45) Date of Patent: Nov. 1, 2016

(54) H-SECTION STEEL

(71) Applicant: NIPPON STEEL & SUMITOMO METAL CORPORATION, Chiyoda-ku, Tokyo (JP)

(72) Inventors: Masaki Mizoguchi, Tokyo (JP); Kazutoshi Ichikawa, Tokyo (JP); Kazuaki Mitsuyasu, Tokyo (JP); Hirokazu Sugiyama, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/416,403

(22) PCT Filed: Nov. 13, 2013

(86) PCT No.: PCT/JP2013/080660

§ 371 (c)(1),
(2) Date: Jan. 22, 2015

(87) PCT Pub. No.: WO2014/080818

PCT Pub. Date: May 30, 2014

(65) Prior Publication Data

US 2015/0204071 A1 Jul. 23, 2015

(30) Foreign Application Priority Data

Nov. 26, 2012 (JP) ..... 2012-257892

(51) Int. Cl.
*C22C 38/02* (2006.01)
*C22C 38/04* (2006.01)
(Continued)

(52) U.S. Cl.
CPC ..... *E04C 2/30* (2013.01); *B21B 1/088* (2013.01); *B21B 3/00* (2013.01); *C21D 6/001* (2013.01);
(Continued)

(58) Field of Classification Search
None
See application file for complete search history.

(56) References Cited

U.S. PATENT DOCUMENTS 4,990,196 A 2/1991 Tamehiro et al.
6,258,181 B1 7/2001 Yamamoto et al.
(Continued)

FOREIGN PATENT DOCUMENTS

CN 101397627 A 4/2009
CN 101407893 A 4/2009
(Continued)

OTHER PUBLICATIONS

Machine-English translation of Japanese Patent No. 2002-256377A, Minagawa Masanori et al., Sep. 11, 2002.*
International Search Report dated Feb. 4, 2014 issued in corresponding PCT Application No. PCT/JP2013/080660 [with English Translation].
Office Action dated Aug. 19, 2014 issued in corresponding Japanese Application No. 2014-517284 [with English Translation].
Office Action issued on Jan. 14, 2016 in corresponding Chinese Application No. 201380039137.1.
(Continued)

*Primary Examiner* — Deborah Yee
(74) *Attorney, Agent, or Firm* — Birch, Stewart, Kolasch & Birch, LLP

(57) ABSTRACT

There is provided an H-section steel in which a number density of oxide particles having an equivalent circle diameter of 0.005 μm to 2.0 μm per unit area is 100 pieces/mm$^2$ to 5000 pieces/mm$^2$, the oxide particles includes Ca, Al, and O as a composition, the amount of Ca is 5% or more, the amount of Al is 5% or more, and a total amount of Ca and Al is 50% or more by mass ratio excluding O in the oxide particles, a thickness of the flange is 100 mm to 150 mm, a bainite fraction in a metallographic structure of the flange is 80% or more at a strength evaluation position, and an average prior austenite grain size in the metallographic structure of the flange is 200 μm or less at a toughness evaluation position.

16 Claims, 2 Drawing Sheets

(51) Int. Cl.

| | |
|---|---|
| ***C22C 38/12*** | (2006.01) |
| ***C22C 38/14*** | (2006.01) |
| ***E04C 3/04*** | (2006.01) |
| ***E04C 2/08*** | (2006.01) |
| ***E04C 2/30*** | (2006.01) |
| ***B21B 1/088*** | (2006.01) |
| ***B21B 3/00*** | (2006.01) |
| ***C22C 38/00*** | (2006.01) |
| ***C22C 38/58*** | (2006.01) |
| ***C22C 38/06*** | (2006.01) |
| ***C22C 38/08*** | (2006.01) |
| ***C22C 38/16*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C21D 6/00*** | (2006.01) |
| ***C21D 8/02*** | (2006.01) |
| *C21D 8/00* | (2006.01) |
| *C21C 7/04* | (2006.01) |
| *C21C 7/064* | (2006.01) |
| *C21D 1/60* | (2006.01) |

(52) U.S. Cl.

CPC ..... *C21D 6/004* (2013.01); *C21D 6/005* (2013.01); *C21D 6/008* (2013.01); *C21D 8/005* (2013.01); *C21D 8/0226* (2013.01); *C21D 8/0247* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *E04C 2/08* (2013.01); *E04C 3/04* (2013.01); *C21C 7/04* (2013.01); *C21C 7/064* (2013.01); *C21D 1/60* (2013.01); *C21D 8/00* (2013.01); *C21D 2211/002* (2013.01); *C21D 2211/004* (2013.01)

(56) References Cited

U.S. PATENT DOCUMENTS

| | | | | |
|---|---|---|---|---|
| 9,057,122 | B2 * | 6/2015 | Takaoka | C22C 38/001 |
| 2005/0167013 | A1 | 8/2005 | Murao et al. | |
| 2010/0330387 | A1 | 12/2010 | Yoshida et al. | |

FOREIGN PATENT DOCUMENTS

| | | | |
|---|---|---|---|
| CN | 101541994 | | 9/2009 |
| EP | 0761824 | | 3/1997 |
| EP | 0940477 | A1 | 9/1999 |
| JP | 04279247 | | 10/1992 |
| JP | 05-263182 | | 10/1993 |
| JP | 07-090474 | | 4/1995 |
| JP | 09194985 | | 7/1997 |
| JP | 10-147835 | | 6/1998 |
| JP | 11-131188 | | 5/1999 |
| JP | 2000-054060 | | 2/2000 |
| JP | 2000080440 | | 3/2000 |
| JP | 2000-328174 | | 11/2000 |
| JP | 2001-003136 | | 1/2001 |
| JP | 2003160833 | | 6/2003 |
| JP | 3960341 | B | 8/2007 |
| JP | 2007277629 | | 10/2007 |
| JP | 2011106006 | | 6/2011 |
| JP | 2011-157573 | | 8/2011 |
| JP | 2011-179106 | A | 9/2011 |
| JP | 2011246806 | | 12/2011 |
| WO | WO 01/75182 | | 10/2001 |
| WO | WO 2010/013358 | | 2/2010 |
| WO | WO 2011/065479 | | 6/2011 |

OTHER PUBLICATIONS

Search report issued om Mar. 18, 2016 in corresponding European Application No. 13856612.0.

International Search Report dated Feb. 12, 2013 issued in PCT Application No. PCT/JP2012/082043 [with English Translation].

Office Action dated May 1, 2015 issued in U.S. Appl. No. 14/357,604.

European Search Report dated May 4, 2015 issued in European Application No. 12856806.0.

Office Action dated Aug. 4, 2015 issued in Chinese Application No. 201280056107.7 [with English Translation of part of Search Report].

Office Action dated May 18, 2016 issued in U.S. Appl. No. 14/357,604.

* cited by examiner

H-SECTION STEEL

TECHNICAL FIELD OF THE INVENTION

This application is a national stage application of International Application No. PCT/JP2013/080660, filed Nov. 13, 2013, which claims priority to Japanese Patent Application No. 2012-257892, filed on Nov. 26, 2012, each of which is incorporated by reference in its entirety.

The present invention relates to a high-strength ultra-thick H-section steel having excellent toughness, which is used for structural members of buildings, and a method for producing the same.

RELATED ART

The use of H-section steel having a thickness of 100 mm or more (hereinafter, referred to as an ultra-thick H-section steel) is demanded in building structures, particularly, super high-rised buildings. Generally, as for ferrous materials, as the strength increases or as the thickness of a product increases, the toughness tends to decrease. Therefore, it is difficult to ensure the toughness of high-strength and thick steel.

Further, the H-section steel has a peculiar shape compared to the shape of a steel sheet. It is preferable to produce the H-section steel by universal rolling. However, the rolling conditions (such as temperature or reduction) are limited in the universal rolling. Therefore, particularly in the production of the ultra-thick H-section steel, there are significant differences in a temperature history during rolling, a reduction, a cooling rate at accelerated cooling in each portion of a web, flange, and a fillet. As a result, there are significant differences in strength, ductility, and toughness in the cross section of the ultra-thick H-section steel according to positions.

Particularly, when a slab that is obtained by continuous casting is hot-rolled to produce an ultra-thick H-section steel, it is difficult to ensure the toughness by refining grains. This is because it takes more time to roll the ultra-thick H-section steel than to roll a steel sheet having a normal thickness and when the rolling ends, the inside temperature tends to be much higher than the surface temperature.

In the related art, in regard to improvement in the toughness of an H-section steel, for example, in Patent Document 1, there is disclosed a method for refining grains by dispersing Ti-based oxides in steel and forming intragranular ferrite. Further, for example, in Patent Documents 2 to 4, there is disclosed a method for producing a rolled section steel having high strength and excellent toughness by temperature control rolling and accelerated cooling, in addition to Ti-based oxides and TiN fine dispersion.

In addition, for example, in Patent Documents 5 to 7, a method is disclosed for improving toughness by dispersing oxides and refining a structure by a pinning effect of the dispersed oxides. Patent Document 5 discloses a technique for improving the toughness of an ultra-thick H-section steel using line oxides including Mg and Patent Documents 6 and 7 disclose a technique for improving the toughness of an ultra-thick H-section steel using Ti oxides.

PRIOR ART DOCUMENT

Patent Document

[Patent Document 1] Japanese Unexamined Patent Application, First Publication No. H05-263182

[Patent Document 2] Japanese Unexamined Patent Application, First Publication No. H10-147835

[Patent Document 3] Japanese Unexamined Patent Application, First Publication No. 2000-54060

[Patent Document 4] Japanese Unexamined Patent Application, First Publication No. 2001-3136

[Patent Document 5] Japanese Unexamined Patent Application, First Publication No. 2000-328174

[Patent Document 6] PCT International Publication No. WO 2010-013358

[Patent Document 7] PCT International Publication No. WO 2011-065479

DISCLOSURE OF THE INVENTION

Problems to be Solved by the Invention

In order to ensure the strength in the vicinity of the surface of steel, it is necessary to form a low temperature transformation structure by finishing a rolling before the temperature of the vicinity of the surface reaches a transformation start temperature ($Ar_3$ point) and then starting a water cooling. However, when an ultra-thick H-section steel having a flange thickness of 100 mm or more is produced, there is a tendency of a temperature difference between the surface and the inside in the rolling process being significant. As a result of an investigation by a computer simulation, for example, the present inventors made it clear that when an H-section steel having a flange thickness of 125 mm was produced, the temperature difference between the surface and the inside was 200° C. or higher.

Accordingly, in the ultra-thick H-section steel, when rolling ends before the steel surface temperature reaches a ferrite transformation start temperature ($Ar_3$ point), the temperature inside the steel is 1100° C. or higher in some cases and thus there is a concern that austenite grains may be coarsened. Therefore, when a sample is taken from the inside of the ultra-thick H-section steel the toughness may be significantly deteriorated.

Further, when water cooling is performed after hot rolling, it is hard to increase the cooling rate inside the steel. Therefore, it is difficult to refine the structure inside the steel.

The present invention has been made in view of the above circumstances, and an object thereof is to provide a high-strength ultra-thick H-section steel having excellent toughness and a method for producing the same. The H-section steel of the present invention is not a build-up H-section steel formed by welding a steel plate but a rolled H-section steel which is formed by hot rolling, particularly, universal rolling, and does not require treatment such as tempering after quenching.

In the present invention, the term "high strength" refers to a tensile strength of 550 MPa or more.

Means for Solving the Problem

In order to improve the toughness of the H-section steel, it is preferable that hardenability be improved by refining austenite grains and containing an alloy element so as to suppress the formation of intragranular ferrite and form a structure mainly consisting of bainite. The present inventors conducted an investigation on the type, size, and density of oxide particles necessary for refining the austenite grain size in hot rolling and a chemical composition necessary for refining the structure at the time of water cooling in detail to ensure the toughness of the ultra-thick H-section steel.

As a result, it has been found that when oxides including Al and Ca in the steel are formed and the austenite grain size is reduced to 200 μm or less by the pinning effect of these oxides, the toughness of the ultra-thick H-section steel having a flange thickness of 100 mm or more can be remarkably improved, further, it has been found that the toughness of the high-strength ultra-thick H-section steel is further improved by appropriately controlling components such as Si, Mn, V, and Ni in addition to reducing the austenite grain size and thus the present invention has been completed. The gist of the present invention is as follows.

(1) According to an aspect of the present invention, there is provided an H-section steel including a flange, and a web, in which the steel includes, as a chemical composition, by mass %, C: 0.05% to 0.16%, Si: 0.01% to 0.50%, Mn: 0.80% to 2.00%, Ni: 0.05% to 0.50%, V: 0.01% to 0.20%, Al: 0.005% to 0.100%, Ti: 0.005% to 0.030%, N: 0.0010% to 0.0200%, O: 0.0001% to 0.0100%, Ca: 0.0003% to 0.0040%, Cr: 0% to 0.50%, Cu: 0% to 0.50%, Mo: 0% to 0.20%, Nb: 0% to 0.05%, and a balance consisting of Fe and impurities, a carbon equivalent Ceq obtained by the following expression (a) is 0.35% to 0.50%, a number density of oxide particles having an equivalent circle diameter of 0.005 μm to 2.0 μm per unit area is 100 pieces/mm$^2$ to 5000 pieces/mm$^2$, the oxide particle includes Ca, Al, and O as a composition, an amount of Ca is 5% or more, an amount of Al is 5% or more, and a total amount of Ca and Al is 50% or more by mass ratio excluding O in the oxide particle, a thickness of the flange is 100 mm to 150 mm, a bainite fraction in a metallographic structure of the flange is 80% or more at a strength evaluation position which is a ⅙ position from a surface of the flange in a length direction and is a ¼ position from the surface of the flange in a thickness direction, and an average prior austenite grain size in the metallographic structure of the flange is 200 μm or less at a toughness evaluation position which is a ½ position from the surface of the flange in the length direction and is a ¾ position from the surface of the flange in the thickness direction.

$$Ceq=C+Mn/6+(Cr+Mo+V)/5+(Ni+Cu)/15 \quad \text{Expression (a)}$$

Here, C, Mn, Cr, Mo, V, Ni, and Cu in the expression represent an amount (mass %) of each element, and elements which are not added are indicated as 0.

(2) The H-section steel according to (1) may include as a chemical composition, by mass %: Cr: 0.01% to 0.50%; Cu: 0.01% to 0.50%; Mo: 0.001% to 0.20%; and Nb: 0.001% to 0.05%.

(3) In the H-section steel according to (1) or (2), a yield strength or a 0.2% proof stress may be 450 MPa or more, a tensile strength may be 550 MPa or more, and a Charpy absorbed energy at 21° C. may be 100 J or more at the strength evaluation position.

(4) In the H-section steel according to any one of (1) to (3), the inclusion particle may contain Ti.

(5) In the H-section steel according to any one of (1) to (4), the steel may be produced by universal rolling.

(6) According to another aspect of the present invention, a method is provided for producing an H-section steel including adjusting an amount of oxygen in molten steel before a deoxidizing treatment is performed to 90 ppm or less and adding Ti, Ai, and Ca to the molten steel sequentially, and then adjusting a component composition of the molten steel so that the steel includes, as a chemical composition, by mass %, C: 0.05% to 0.16%, Si: 0.01% to 0.50%, Mn: 0.80% to 2.00%. Ni: 0.05% to 0.50%, V: 0.0.1% to 0.20%, Al: 0.005% to 0.100%, Ti: 0.005% to 0.030%. N: 0.0010% to 0.0200%, O: 0.0001% to 0.0100%, Ca: 0.0003% to 0.0040%, Cr: 0% to 0.50%, Cu: 0% to 0.50%, Mo: 0% to 0.20%, Nb: 0% to 0.05%, and a balance consisting of Fe and impurities and has a carbon equivalent Ceq obtained by the following expression (a) of 0.35% to 0.50%, casting the molten steel obtained in the adjusting of the amount of oxygen to obtain a slab, heating the slab obtained in the casting of the molten steel to 1100° C. to 1350° C. hot-rolling the heated slab so that a rolling end temperature of a surface temperature is 800° C. or higher to thereby obtain an H-section steel, and water-cooling the H-section steel so that a surface temperature of the H-section steel is recuperated to 100° C. to 700° C. alter stopping the water-cooling.

$$Ceq=C+Mn/6+(Cr+Mo+V)/5+(Ni+Cu)/15 \quad \text{Expression (a)}$$

Here, C, Mn, Cr, Mo, V, Ni, and Cu in the expression represent the amount (mass %) of each element, and elements which are not added are indicated as 0.

(7) In the method for producing an H-section steel according to (6), the steel may include, as a chemical composition, by mass %, Cr: 0.01% to 0.50%, Cu: 0.01% to 0.50%, Mo: 0.001% to 0.20%, and Nb: 0.001% to 0.05%.

Effects of the Invention

According to the above-described aspect of the present invention, it is possible to obtain a high-strength ultra-thick H-section steel having excellent toughness in which the flange thickness is 1.00 mm to 1.50 mm, the yield strength or 0.2% proof stress is 450 MPa or more, the tensile strength is 550 MPa or more, and the Charpy absorbed energy at 21° C. is 100 J or more. The H-section steel of the present invention (high-strength ultra-thick H-section steel having excellent toughness) can be produced without requiring a large amount of an alloy to be contained and without performing ultra-low-carbonization in which a steel production load is large. Therefore, a remarkable cost reduction resulting from a production cost reduction and shortening of the period of time for work can be promoted. Accordingly, the steel remarkably contributes to the industry such that the reliability of a large building structure can be improved without impairing economic efficiency.

EMBODIMENTS OF THE INVENTION

Figure 1:
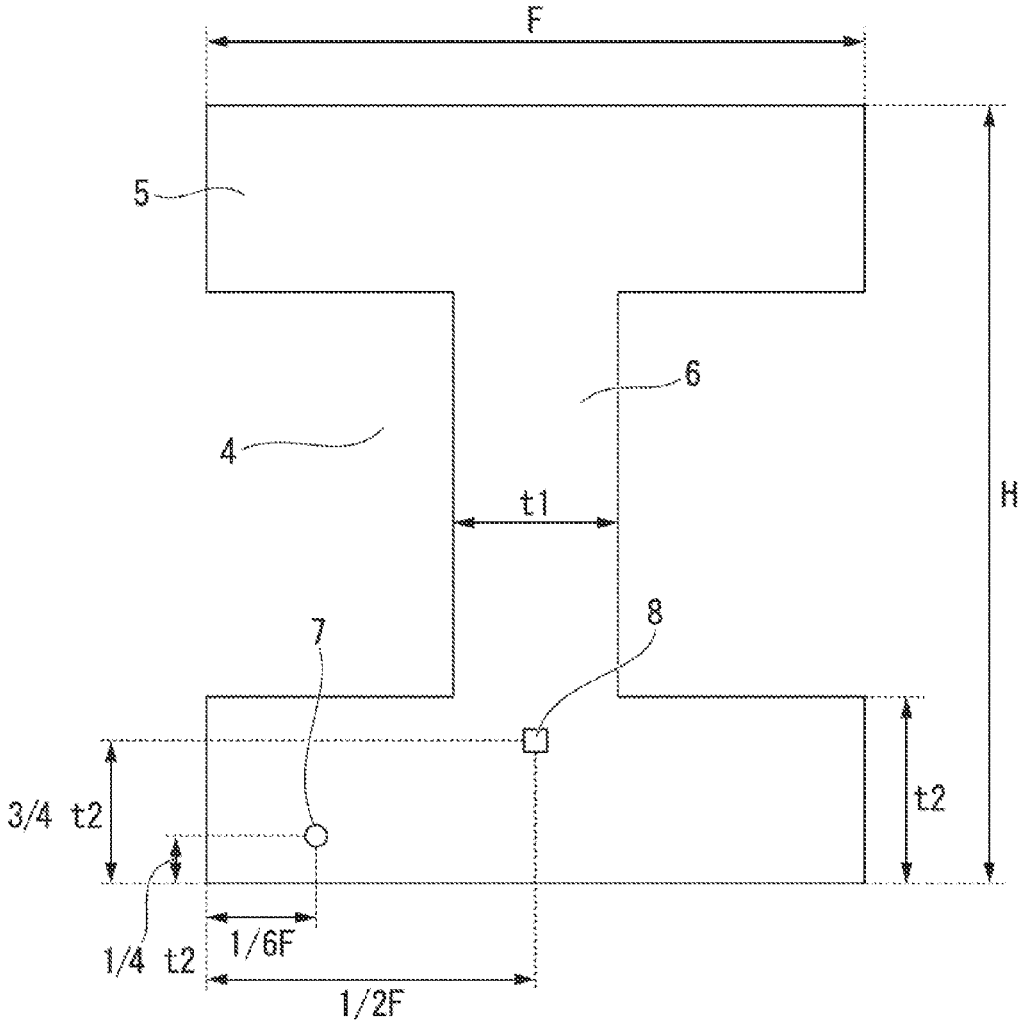
FIG. 1 is a view illustrating a position from which a test sample is taken in an H-section steel according to an embodiment.

The present inventors have found the fact that oxides including at least Ca, Al, and O are finely dispersed in steel by adding Ti, Al, and Ca at the time of deoxidation and a carbon equivalent Ceq is in an appropriate range is effective to ensure good toughness of an ultra-thick H-section steel having a flange thickness of 100 mm or more.

The present inventors have found that when the steel having such a component composition is hot-rolled and then subjected to accelerated cooling by water cooling to thereby produce an ultra-thick H-section steel, the area fraction of bainite in the metallographic structure of the ultra-thick H-section steel is 80% or more by suppressing the formation of ferrite which is transformed from the austenite grain boundary and as a result, sufficient strength can be ensured without deteriorating the toughness.

Hereinafter, an H-section steel according to an embodiment of the present invention (also referred to as an H-section steel according to an embodiment below) and a method for producing the same will be described. First, the reason why the component range of the H-section steel according to the embodiment is limited will be described. Here, "%" relating to component elements means mass %.

C: 0.05% to 0.16%

C is an element effective in increasing the strength of the steel and in order to obtain the effect, the lower limit of the amount of C is set to 0.05%. The lower limit of the amount of C is preferably 0.08%, On the other hand, when the amount of C is more than 0.16%, carbides are formed and the toughness is deteriorated. Therefore, the upper limit of the amount of C is set to 0.16%. In order to further improve the toughness, the upper limit of the amount of C is preferably 0.13%.

Si: 0.01% to 0.50%

Si is a deoxidizing element and also contributes to improvement in the strength. In order to obtain these effects, the lower limit of the amount of Si is set to 0.01%. On the other hand, when an excessive amount of Si is contained, the formation of a martensite-austenite constituent (hereinafter, referred to as MA) is promoted. Since the MA deteriorates the toughness, the upper limit of the amount of Si is set to 0.50%. In order to further improve the toughness, the upper limit of the amount of Si is preferably 0.30% and more preferably 0.20%.

Mn: 0.80% to 2.00%

Mn forms bainite by improving the hardenability and also contributes to improvement in the strength and the toughness by suppressing ferrite formation from prior austenite grain boundary. In order to obtain these effects, the lower limit of the amount of Mn is set to 0.80%. In order to improve the strength, the lower limit of the amount of Mn is preferably 1.10% and more preferably 1.20%. On the other hand, when the amount of Mn is more than 2.00%, the toughness and cracking properties of the steel are deteriorated and thus the upper limit of the amount of Mn is set to 2.00%. The upper limit of the amount of Mn is preferably 1.80% and more preferably 1.60%.

Ni: 0.05% to 0.50%

Ni is an element very effective to increase the strength and the toughness of the steel. In order to obtain these effects, the lower limit of the amount of Ni is set to 0.05%. In order to further improve the toughness, the lower limit of the amount of Ni is preferably 0.10%. On the other hand, when the amount of Ni is more than 0.50%, the alloy cost increases and thus the upper limit of the amount of Ni is set to 0.50%. The upper limit of the amount of Ni is preferably 0.30%.

V: 0.01% to 0.20%

V is an element that contributes to improvement in the hardenability and further forms carbonitrides to contribute to structure refinement and precipitation strengthening. In order to obtain these effects, the lower limit of the amount of V is set to 0.01%. The lower limit of the amount of V is preferably 0.05%. However, when an excessive amount of V is contained, the toughness of the steel may be deteriorated due to coarsening of precipitates. Therefore, the upper limit of the amount of V is set to 0.20%. The upper limit of the amount of V is preferably 0.08%.

Al: 0.005% to 0.100%

Al is an important element to form oxide particles which refine austenite grains by a pinning effect. In order to obtain the effect, the lower limit of the amount of Al is set to 0.005%. The lower limit of the amount of Al is preferably 0.010%. On the other hand, when an excessive amount of Al is contained, coarse oxides are formed. Accordingly, the upper limit of the amount of Al is set to 0.100%. The upper limit of the amount of Al is preferably 0.060% and more preferably 0.040%.

Ti: 0.005% to 0.030%

Ti is, like Al, an element necessary for forming oxide particles which refine austenite grains by a pinning effect. In order to obtain the effect, the lower limit of the amount of Ti is set to 0.005%. The lower limit, of the amount of Ti is preferably 0.010%. On the other hand, when the amount of Ti is more than 0.030%, coarse TiN is formed in the steel and thus the toughness is deteriorated. Accordingly, the upper limit of the amount of Ti is set to 0.030%. The upper limit of the amount of Ti is preferably 0.020% in order to suppress deterioration in the toughness resulting from precipitation strengthening by suppressing precipitation of TiC.

N: 0.001.0% to 0.0200%

N is an important element which forms TiN and VN and is an element which contributes to grain refinement of the structure and precipitation strengthening, in order to obtain these effects, the lower limit of the amount of N is set to 0.0010%. However, when an excessive amount of N is contained, the toughness of the steel is deteriorated and also a quality defect such as surface cracks at the time of casting and strain aging of produced steel is caused. Therefore, die upper limit of the amount of N is set to 0.0200%. The upper limit of the amount of N is preferably 0.0100%.

O: 0.0001% to 0.0100%

O is an element which forms oxides with Ti, Al, and Ca, and is an element necessary for promoting austenite grain refinement by a pinning effect in the embodiment. In order to obtain the effect, the lower limit of the amount of O is set to 0.0001%. The lower limit of the amount of O is preferably 0.0005%. However, when an excessive amount of O is contained, the toughness is deteriorated due to the effect of solute O and coarsening of oxide particles. Therefore, the upper limit of the amount of O is set to 0.0.100%. The upper limit of the amount of O is preferably 0.0050%.

Ca: 0.0003% to 0.0040%

Ca is an element which forms composite oxides with Ti and Al and is an element necessary for promoting austenite grain refinement by a pinning effect in the embodiment. In order to obtain the effect, the lower limit of the amount of Ca is set to 0.0003%. The lower limit of the amount of Ca is preferably 0.0005% and more preferably 0.0010%. However, when an excessive amount of Ca is contained, oxide particles are coarsened and thus the toughness is deteriorated. Therefore, the upper limit of the amount of Ca is set to 0.0040%. The upper limit of the amount of Ca is preferably 0.0030%.

The H-section steel according to the embodiment basically contains the above-described elements and may include the following elements as impurities within a range which does not deteriorate the properties. The term "impurities" refers to elements that are mixed from raw materials such as ore and scrap or the production environment.

For example, P and S are impurities and are included in the steel unavoidably, in the embodiment, the amounts of these elements are not particularly limited. However, since P and S cause welding cracks resulting from solidification segregation and deterioration in the toughness, it is preferable to reduce the amounts of the elements. The amount of P is preferably limited to 0.03% or less and more preferably limited to 0.01% or less. In addition, the amount of S is preferably limited to 0.02% or less.

Further, in order to improve the hardenability, one or more of Cr, Cu, Mo, and Nb may be contained within the ranges shown below. Cr, Cu, Mo, and Nb are optional elements and are not necessarily contained. Therefore, all the lower limits of these elements are set to 0%.

Cr: 0.50% or less

Cr is an element which contributes to an increase in the strength by improving the hardenability. In order to obtain the effect of improving the hardenability, the amount of Cr is preferably 0.01% or more and more preferably 0.10% or more. On the other hand, when the amount of Cr is more titan 0.50%, the formation of MA is promoted and Cr carbides are coarsened and thus the toughness may be deteriorated. Therefore, even when Cr is contained, the upper limit of the amount of Cr is preferably limited to 0.50%. The upper limit of the amount of Cr is more preferably 0.30%.

Cu: 0.50% or less

Cu is an element which contributes to strengthening of the steel by improvement in the hardenability and precipitation strengthening. In order to obtain these effects, the amount of Cu is preferably 0.01% or more and more preferably 0.10% or more. However, when an excessive amount of Cu is contained, the formation of MA is promoted or the strength increases excessively and thus the low-temperature toughness may be deteriorated. Therefore, even when Cu is contained, the upper limit of the amount of Cu is preferably 0.50%. The upper limit of the amount of Cu is more preferably 0.30% and still more preferably 0.20%.

Mo: 0.20% or less

Mo is an element which is solid-solved in the steel to improve the hardenability and contributes to improvement in the strength. In order to obtain the effect, the amount of Mo is preferably 0.001% or more. The amount of Mo is more preferably 0.01% or more and still more preferably 0.03% or more. However, when the amount of Mo is more than 0.20%, the formation of MA is promoted and thus the toughness is deteriorated. Therefore, even when Mo is contained, the upper limit of the amount of Mo is preferably 0.20%. The upper limit of the amount of Mo is more preferably 0.10% to prevent deterioration in the toughness.

Nb: 0.05% or less

Nb is, like Mo, an element which improves the hardenability. In order to obtain the effect, the amount of Nb is preferably 0.001% or more, more preferably 0.005% or more, and still more preferably 0.010% or more. However, when an excessive amount of Nb is contained, the toughness may be deteriorated. Thus, even when Nb is contained, the upper limit of the amount of Nb is preferably 0.05%. The upper limit of the amount of Nb is more preferably 0.03%.

In the embodiment, the amount of each element is controlled to fail in the above-described ranges and a carbon equivalent Ceq expressed by the following expression (1) is set to be 0.35% to 0.50% so as to form bainite by improving the hardenability. When the Ceq is less than 0.35%, bainite is not sufficiently formed and the strength and the toughness are deteriorated. Therefore, the lower limit of the Ceq is set to 0.35%. The lower limit of the Ceq is preferably 0.38% and more preferably 0.40%. On the other hand, when the Ceq is more than 0.50%, the strength is excessively increased and the toughness is deteriorated. Therefore, the upper limit of the Ceq is set to 0.50%. The upper limit of the Ceq is preferably 0.45% and more preferably 0.43%.

The Ceq is a parameter of the hardenability (carbon equivalent) and can be obtained by a known expression (1). Here, C, Mo, Cr, Mo, V, Ni, and Cu in the expression represent the amount (per unit mass %) of each element, and elements which are not added are indicated as 0.

$$Ceq=C+Mn/6+(Cr+Mo+V)/5+(Ni+Cu)/15 \quad \text{Expression (1)}$$

Next, the microstructure (metallographic structure) of the H-section steel according to the embodiment will be described. Generally, in a ultra-thick H-section steel, since the rolling finish temperature is low and the cooling rate is high at the time of water cooling in the vicinity of the surface, the austenite grains are fine. On the other hand, since the rolling finish temperature is high and the cooling rate is low at the time of water cooling in the inside of the steel, the austenite grains are coarse.

In the embodiment, a sample used for evaluating the strength is taken from a portion in which an average structure is expected to be obtained and then the strength evaluation and the microstructure observation are performed and the area fraction of bainite is measured (strength evaluation position). As illustrated in FIG. 1, a strength evaluation position 7 is a ⅙ position from the surface of the flange (end surface of the H-section steel) in the length direction and is a ¼ position from the surface of the flange in the thickness direction. Each structure can be determined through the observation using an optical microscope. The area fraction in the microstructure is calculated as a ratio of the number of grains of each structure by using a structure photograph photographed at a magnitude of 200 by the optical microscope, arranging measurement points in a lattice shape having a side of 50 μm, and determining the structure with 300 measurement points.

Bainite contributes to an increase in the strength and refinement of the structure. In order to ensure the strength, it is necessary to include bainite at an area fraction of 80% or more at the strength evaluation position in the steel structure (metallographic structure). The balance includes one or more of ferrite, pearlite, and MA. An increase in the area fraction of bainite contributes to improvement of the strength and thus the upper limit of the area fraction of bainite is not particularly defined and the upper limit thereof may be 100%. The upper limit of the area traction of bainite is preferably 97% or less.

In addition, in the H-section steel according to the embodiment, in the vicinity of the thickness center, since the rolling finish temperature is high the austenite grains are coarsened. Further, since the cooling rate is low at the time of water cooling, the intragranular ferrite is easily coarsened. Accordingly, in the embodiment, a sample is taken from the portion having the lowest toughness to evaluate the toughness and the microstructure is observed at the same portion to evaluate the austenite grain size (toughness evaluation position). As illustrated in FIG. 1, a toughness evaluation position 8 is a ½ position of the flange length from the surface of the flange in the length direction and is a ¾ position of the flange thickness from the surface in the thickness direction. The austenite grain size after cooling (prior austenite grain size) can be measured in such a manner that an optical microscope photograph or an EBSP image is photographed with respect to a field of view of 1000 μm×1000 μm or more, an area per size of one prior austenite grain is calculated by counting the number of prior austenite included therein (counted as 0.5 pieces at the boundary), and then the obtained area value is converted into a diameter of a circle having fire same area.

The present inventors conducted prior austenite grain size evaluation by observing the microstructure at the toughness evaluation position. As a result, in order to improve the toughness, it was found that an average prior austenite grain size had to be controlled to 200 μm or less. Then, it was found that as long as Al—Ca based oxides (here, when the whole Ti was not reduced by addition of Al and Ca, Ti—Al—Ca-based oxides is formed in some cases) having a predetermined size and a predetermined number density were dispersed in the steel, even when hot rolling ended at a high temperature, an average prior austenite grain size of 200 μm or less was able to be obtained. The smaller the prior austenite grain size is, the more preferable it is. However, from the viewpoint of the production, it is not preferable that the prior austenite gram size is less than 100 μm.

When the H-section steel is produced using a continuously cast slab, a portion for evaluating the toughness corresponds to the center of the slab. Accordingly, in order to further suppress deterioration in the toughness, it is preferable to alleviate the center segregation of the slab. The center segregation can be alleviated by soft reduction or homogenizing heat treatment at the time of continuous casting.

In the embodiment, it is necessary to finely disperse oxides including at least Al and Ca in the slab before rolling. According to the investigation of the present inventors, it was found that when the number density of oxide particles including Al and Ca having an equivalent circle diameter of 0.005 μm to 2.0 μm was 100 pieces/mm$^2$ or more, the austenite grain size was able to be reduced to 200 μm or less by the pinning effect and the recrystallizalion effect by rolling. On the other hand, when the number density of the oxide particles is more than 5000 pieces/mm$^2$, the occurrence of fracture and the propagation of cracks are promoted and the toughness may be deteriorated. The number density of the oxide particles is preferably 3000 pieces/mm$^2$ or less. The number density of the oxide particles was calculated by preparing an extraction replica from the produced H-section steel and observing the replica using an electron microscope. The compositions of the oxides were analyzed using an energy dispersive X-ray spectroscopy (EDS) attached to the electron microscope.

The present inventors found that when the oxide particles including above-described Al and Ca included Ca, Al, and O, the elements excluding O of Ca: 5% or more and Al: 5% or more were respectively contained by mass ratio, and a total of Ca and Al was 50% or more, the composition contributed to austenite grain size refinement. When the H-section steel was produced by a production method according to an embodiment, the upper limits of the amounts of Ca and Al excluding O are generally 95%. The amount of Al is preferably 90% or less and more preferably 85% or less. The amount of Ca is preferably 90% or less and more preferably 85% or less. In addition, a total amount of Ca and Al excluding O is preferably 99% or less.

In the embodiment, it is assumed that the slab is heated at a maximum temperature of 1350° C. for a maximum time of 5 hours. The present inventors confirm that as long as the oxides have the above-described compositions, even when the slab is heated under such a condition, the pinning effect for the austenite grains is not lost since reduction in the precipitation density of the above-described oxides is not caused. Further, it is also confirmed that as long as the size of such oxide particles is 2.0 μm or less, the oxide does not become the origin of brittle fracture of the ultra-thick H-section steel.

The thickness of the flange of the H-section steel according to the embodiment is set to 100 mm to 150 mm. This is because a strength member having a thickness of 100 mm or more is required as an H-section steel used in tall building structures, for example. On the other hand, when the thickness of the flange is more than 1.50 mm, a sufficient cooling rate is not obtained and the toughness is hardly ensured. Thus, the upper limit thereof is set to 150 mm. The thickness of the web of the H-section steel is not particularly defined. However, the thickness thereof is preferably 50 mm to 150 mm.

The thickness ratio between the flange and the web (flange thickness/web thickness) is preferably 0.5 to 2.0 when it is assumed that the H-section steel is produced by hot rolling. When the thickness ratio between the flange and the web is more than 2.0, the web may be deformed into a rippling shape. On the other hand, when the thickness ratio between the flange and the web is less than 0.5, the flange may be deformed into a rippling shape.

Target values of the mechanical properties are such that the yield strength or 0.2% proof stress is 450 MPa or more and the tensile strength is 550 MPa or more at room temperature. When an H-section steel is produced by a preferable method for producing an H-section steel according to the following embodiment, generally, the yield strength or 0.2% proof stress is 520 MPa or less and the tensile strength is 740 MPa or less at room temperature. In addition, the Charpy absorbed energy at 21° C. is 100 J or more. When the strength is excessively high, the toughness may be deteriorated. Thus, it is preferable that the yield strength or 0.2% proof stress be 500 MPa or less and the tensile strength be 680 MPa or less at room temperature, it is preferable that the Charpy absorbed energy at 21° C. be 150 J or more.

Next, a preferable method for producing an H-section steel according to an embodiment will be described.

A deoxidation method in a steelmaking process is important to control the compositions, number, and size of the oxides to predetermined conditions. In the embodiment, as a deoxidation method, the amount of oxygen in molten steel (molten steel oxygen amount) is adjusted to 90 ppm or less and then Al is added after deoxidation is performed by adding Ti. Next, Ca is added. When the above-described molten steel oxygen amount is more than 90 ppm, a large number of coarse inclusions having a particle size of more than 2.0 μm are formed and thus the toughness is deteriorated. Therefore, the molten steel oxygen amount before Ti is added is set to 90 ppm or less. When the amount of Al is not sufficient with respect to a predetermined component amount after Ca is added, the insufficient amount of Al is added to adjust the component composition such that the final component has a predetermined component value (refining process). When the addition order of Ti, Al, and Ca is not the same as the above-described order, the size of the oxides is coarsened and the number thereof decreases and thus the above case is not preferable.

In the steelmaking process, alter the chemical composition of the molten steel is adjusted, the steel is cast and thus a slab is obtained (casting process). As for the casting, continuous casting is preferable from viewpoint of the productivity. However, a beam blank, having a shape close to the shape of an H-section steel to be produced may be used. The thickness of the slab is preferably 200 mm or more from the viewpoint of the productivity. On the other hand, considering reduction in segregation and homogeneity of heating temperature in hot rolling, the thickness thereof is preferably 350 mm or less.

Next, the slab is heated (heating process). Then, the heated slab is subjected to hot rolling (hot rolling process). When the heating temperature of the slab is lower than 1100° C. deformation resistance increases at the time of the hot rolling. Therefore, the lower limit of the heating temperature is set to 1100° C. When an element such as Nb that forms carbides and nitrides is contained, the lower limit, of the heating temperature is preferably 1150° C. to solid-solve these carbides and nitrides sufficiently. On the other hand, when the heating temperature is higher than 1350° C., scales on the surface of the slab as a material are liquefied and may interfere with the production. Therefore, the upper limit of the heating temperature is set to 1350° C.

In the present invention, since the upper limit of the austenite grain size is determined by the pinning effect of the oxide particles, the hot rolling condition may not be defined in detail. However, in order to ensure the strength, the finish rolling temperature is a steel surface temperature of 800° C. or higher.

In the hot rolling, in consideration of the productivity, it is preferable to perform so-called universal rolling.

In the finish rolling, it is preferable to perform the rolling while controlling the rolling temperature and the reduction. In order to improve the toughness by the hot rolling, it is preferable to lower the rolling temperature. This is because when the rolling temperature is lowered, the austenite grain size is refined by the recrystallization effect at the time of rolling and the toughness may be improved. On the other hand, in order to ensure the strength, it is preferable to improve the hardenability. In order to improve the hardenability, it is preferable to raise the rolling temperature and increase the austenite grain size. That is, a lowering of the rolling temperature is preferable to ensure the toughness and a raising of the rolling temperature is preferable to ensure the strength. Therefore, it is preferable that the rolling condition is appropriately controlled according to the chemical composition of steel so that steel having high hardenability is rolled at a low temperature and steel having low hardenability is rolled at a high temperature.

In a process in which the slab obtained by performing primary rolling is cooled to 500° C. or lower and then recuperated to 1100° C. to 1350° C. and subjected to secondary rolling to produce a steel, so-called 2-heat rolling may be adopted. In the 2-heat rolling, the amount of plastic deformation in hot rolling is small and a lowering of the temperature in the rolling process is small. Thus, the heating temperature can be lowered.

When the rolling temperature is lowered, it is effective to perform interpass water cooling rolling in one or more passes in the finish rolling. The interpass water cooling rolling is a method in which the flange surface temperature is cooled to 700° C. or lower and then rolling is performed in the recuperating process. The interpass water cooling rolling is a rolling method in which a temperature difference is imparted between the surface and the inside of the flange by water cooling between rolling passes. In the interpass water cooling rolling, even when the reduction is small, working strain can be introduced into the thickness of the plate, in addition, the rolling temperature is lowered by water cooling in a short period of time and thus the productivity is improved.

After the finish rolling, the flange or the web is water-cooled to obtain high strength (water cooling process). The water cooling can be performed by spraying water using a spray or immersing the steel in a water tank. In the embodiment, it is preferable to perform water cooling so that the cooling rate in a range of 800° C. to 500° C. is 2.2° C./sec or more at a ⅙ position of the flange length from the surface of the flange (end surface of the H-section steel) in the length direction and at a ¼ position of the flange thickness from the surface of the flange in the thickness direction (strength evaluation position). When the cooling rate is lower than 2.2° C./sec, a necessary hardened structure may not be obtained.

In the water cooling, it is necessary to stop the water cooling under the condition in which the surface temperature after the water cooling stops is recuperated to a temperature of 100° C. to 700° C. This is because when the recuperating temperature is lower than 100° C., self tempering is not sufficient and the toughness deteriorated or when the recuperating temperature is higher than 700° C., the thickness center portion is not hardened and thus the toughness is deteriorated due to coarse ferrite formed from the prior austenite grain boundary or the tempering temperature is excessively high even in the vicinity of the thickness surface and thus the strength is deteriorated, in order to further improve the toughness, the recuperating temperature is preferably 300° C. or higher.

The reason why the recuperating temperature is controlled instead of the water cooling stop temperature as the water cooling condition is that a cooling rate deviation between the surface and the inside of the ultra-thick H-section steel is significant and the inside temperature cannot be managed with the surface temperature. While the surface temperature is cooled to 200° C. or lower in a short period of time after the cooling starts, the cooling rate inside steel is lower than the cooling rate of the surface and thus the inside of the steel may not be sufficiently cooled even when the surface temperature is 200° C. or lower, Contrarily, the present inventors found that it was effective to manage the temperature inside the steel with a recuperating temperature by controlling the temperature inside the steel by a water cooling time. When a relationship between a cooling rate and a cooling time and a recuperating temperature is measured in advance, it is possible to control the recuperating temperature of the ultra-thick H-section steel by the cooling time and the cooling rate.

EXAMPLES

Steel having the chemical composition shown in Table 1 was melted to prepare a slab having a thickness of 240 mm to 300 mm by continuous casting. The steel was melted in a converter and deoxidized and an alloy was added thereto to adjust the components. As necessary, vacuum degassing was performed. The obtained slab was heated and hot-rolled to produce an H-section steel. The components shown in Table 1 were obtained by chemically analyzing a sample taken from the produced H-section steel.

TABLE 1

| COMPONENT | CHEMICAL COMPONENT (mass %) | | | | | | | | | | | | | | | |
|---|---|---|---|---|---|---|---|---|---|---|---|---|---|---|---|---|
| No. | C | Si | Mn | Ni | V | Al | Ti | N | O | Ca | Cr | Cu | Mo | Nb | Ceq | REMARKS |
| 1 | 0.159 | 0.20 | 0.82 | 0.44 | 0.180 | 0.020 | 0.011 | 0.0040 | 0.0020 | 0.0010 | | | | | 0.361 | EXAMPLE |
| 2 | 0.155 | 0.20 | 0.83 | 0.20 | 0.055 | 0.025 | 0.015 | 0.0038 | 0.0017 | 0.0020 | 0.21 | 0.20 | 0.03 | | 0.379 | |

TABLE 1-continued

| COMPONENT | CHEMICAL COMPONENT (mass %) | | | | | | | | | | | | | | | |
|---|---|---|---|---|---|---|---|---|---|---|---|---|---|---|---|---|
| No. | C | Si | Mn | Ni | V | Al | Ti | N | O | Ca | Cr | Cu | Mo | Nb | Ceq | REMARKS |
| 3 | 0.130 | 0.31 | 1.55 | 0.05 | 0.050 | 0.028 | 0.012 | 0.0030 | 0.0019 | 0.0023 | | | | | 0.402 | |
| 4 | 0.130 | 0.30 | 1.55 | 0.44 | 0.110 | 0.030 | 0.009 | 0.0029 | 0.0014 | 0.0031 | 0.10 | 0.31 | 0.07 | 0.010 | 0.494 | |
| 5 | 0.120 | 0.03 | 1.53 | 0.10 | 0.055 | 0.015 | 0.011 | 0.0017 | 0.0005 | 0.0039 | | 0.20 | 0.03 | | 0.412 | |
| 6 | 0.119 | 0.03 | 1.22 | 0.40 | 0.010 | 0.016 | 0.022 | 0.0014 | 0.0008 | 0.0038 | | 0.40 | 0.10 | | 0.398 | |
| 7 | 0.111 | 0.10 | 1.00 | 0.20 | 0.040 | 0.009 | 0.010 | 0.0101 | 0.0005 | 0.0005 | 0.25 | 0.20 | | 0.030 | 0.362 | |
| 8 | 0.112 | 0.11 | 1.51 | 0.10 | 0.041 | 0.007 | 0.010 | 0.0095 | 0.0004 | 0.0004 | 0.10 | 0.19 | 0.03 | | 0.417 | |
| 9 | 0.099 | 0.44 | 1.55 | 0.11 | 0.058 | 0.060 | 0.006 | 0.0030 | 0.0070 | 0.0010 | | | | | 0.376 | |
| 10 | 0.098 | 0.42 | 1.56 | 0.12 | 0.057 | 0.070 | 0.005 | 0.0020 | 0.0061 | 0.0012 | | | | | 0.377 | |
| 11 | 0.088 | 0.09 | 1.40 | 0.19 | 0.080 | 0.040 | 0.027 | 0.0049 | 0.0040 | 0.0009 | | 0.21 | | | 0.364 | |
| 12 | 0.089 | 0.10 | 1.39 | 0.05 | 0.081 | 0.036 | 0.025 | 0.0047 | 0.0035 | 0.0013 | 0.10 | | 0.05 | | 0.370 | |
| 13 | 0.080 | 0.05 | 1.80 | 0.20 | 0.060 | 0.020 | 0.010 | 0.0140 | 0.0025 | 0.0014 | | | | | 0.405 | |
| 14 | 0.081 | 0.05 | 1.77 | 0.20 | 0.062 | 0.021 | 0.009 | 0.0139 | 0.0030 | 0.0009 | | 0.20 | 0.15 | | 0.445 | |
| 15 | 0.070 | 0.20 | 1.61 | 0.08 | 0.120 | 0.070 | 0.011 | 0.0048 | 0.0029 | 0.0009 | | | | | 0.368 | |
| 16 | 0.060 | 0.21 | 1.60 | 0.09 | 0.117 | 0.076 | 0.012 | 0.0046 | 0.0009 | 0.0020 | | | | | 0.356 | |
| 17 | 0.051 | 0.29 | 1.95 | 0.10 | 0.151 | 0.030 | 0.025 | 0.0028 | 0.0040 | 0.0021 | 0.21 | 0.20 | 0.05 | | 0.478 | |
| 18 | 0.180 | 0.25 | 1.47 | 0.10 | 0.049 | 0.044 | 0.013 | 0.0076 | 0.0040 | 0.0021 | 0.22 | 0.13 | | | 0.494 | COMPARATIVE |
| 19 | 0.029 | 0.09 | 1.73 | 0.10 | 0.025 | 0.056 | 0.011 | 0.0048 | 0.0032 | 0.0017 | 0.21 | | 0.05 | | 0.381 | EXAMPLE |
| 20 | 0.123 | 0.72 | 1.48 | 0.41 | 0.054 | 0.029 | 0.011 | 0.0031 | 0.0028 | 0.0014 | 0.12 | | | 0.024 | 0.432 | |
| 21 | 0.094 | 0.39 | 2.20 | 0.09 | 0.039 | 0.030 | 0.014 | 0.0025 | 0.0010 | 0.0018 | | 0.30 | | 0.041 | 0.494 | |
| 22 | 0.140 | 0.32 | 0.59 | 0.15 | 0.058 | 0.019 | 0.023 | 0.0024 | 0.0010 | 0.0021 | 0.34 | 0.40 | 0.06 | | 0.367 | |
| 23 | 0.105 | 0.28 | 1.59 | 0.12 | 0.310 | 0.008 | 0.025 | 0.0017 | 0.0007 | 0.0015 | 0.10 | 0.09 | | 0.008 | 0.466 | |
| 24 | 0.098 | 0.13 | 1.69 | 0.10 | 0.042 | | 0.012 | 0.0039 | 0.0020 | 0.0017 | 0.09 | | | | 0.413 | |
| 25 | 0.104 | 0.15 | 1.51 | 0.11 | 0.058 | 0.023 | 0.001 | 0.0040 | 0.0018 | 0.0014 | 0.10 | 0.20 | 0.05 | | 0.418 | |
| 26 | 0.113 | 0.38 | 1.50 | 0.11 | 0.055 | 0.028 | 0.010 | 0.0035 | 0.0017 | | 0.10 | 0.21 | 0.03 | | 0.421 | |
| 27 | 0.115 | 0.37 | 1.23 | 0.20 | 0.052 | 0.034 | 0.008 | 0.0025 | 0.0031 | 0.0009 | 0.77 | | | | 0.498 | |
| 28 | 0.117 | 0.35 | 1.10 | 0.32 | 0.030 | 0.027 | 0.006 | 0.0020 | 0.0029 | 0.0005 | 0.09 | 0.98 | 0.17 | | 0.445 | |
| 29 | 0.109 | 0.40 | 1.50 | 1.02 | 0.056 | 0.030 | 0.010 | 0.0024 | 0.0018 | 0.0004 | 0.05 | 0.20 | | | 0.462 | |
| 30 | 0.098 | 0.42 | 1.22 | 0.10 | 0.044 | 0.024 | 0.015 | 0.0025 | 0.0005 | 0.0006 | | 0.20 | 0.50 | | 0.430 | |
| 31 | 0.115 | 0.36 | 1.53 | 0.09 | 0.055 | 0.031 | 0.011 | 0.0030 | 0.0008 | 0.0003 | | 0.21 | 0.03 | 0.077 | 0.407 | |
| 32 | 0.149 | 0.27 | 1.80 | 0.23 | 0.055 | 0.035 | 0.014 | 0.0042 | 0.0022 | 0.0016 | 0.15 | 0.20 | 0.05 | | 0.529 | |
| 33 | 0.099 | 0.40 | 1.01 | 0.23 | 0.030 | 0.029 | 0.012 | 0.0033 | 0.0018 | 0.0018 | | | 0.03 | | 0.295 | |
| 34 | 0.120 | 0.29 | 1.20 | 0.23 | 0.005 | 0.030 | 0.013 | 0.0029 | 0.0019 | 0.0020 | 0.20 | | | | 0.376 | |
| 35 | 0.117 | 0.25 | 1.22 | | 0.060 | 0.020 | 0.019 | 0.0019 | 0.0038 | 0.0010 | 0.21 | | | | 0.374 | |

AN EMPTY COLUMN MEANS THAT AN ELEMENT CORRESPONDING TO THE COLUMN IS NOT ADDED INTENTIONALLY.
THE UNDERLINED MEANS THAT THE VALUE IS OUT OF THE RANGE DEFINED IN THE PRESENT INVENTION.

TABLE 2

| PRODUCTION No. | COMPONENT No. | BEFORE DEOXIDATION MOLTEN STEEL OXYGEN AMOUNT ppm | ADDITION ORDER OF Ti, AL, and Ca | FLANGE THICKNESS mm | HEATING TEMPERATURE ° C. | FINISH ROLLING ° C. | COOLING RATE ° C./s | RECUPERATING TEMPERATURE ° C. |
|---|---|---|---|---|---|---|---|---|
| 1 | 1 | 90 | Ti→Al→Ca | 100 | 1300 | 850 | 3.8 | 620 |
| 2 | 2 | 39 | Ti→Al→Ca | 100 | 1300 | 850 | 4.0 | 500 |
| 3 | 3 | 79 | Ti→Al→Ca | 125 | 1300 | 900 | 3.2 | 450 |
| 4 | 4 | 55 | Ti→Al→Ca | 150 | 1350 | 940 | 2.4 | 600 |
| 5 | 5 | 60 | Ti→Al→Ca | 125 | 1300 | 900 | 3.2 | 400 |
| 6 | 5 | 30 | Ti→Al→Ca | 125 | 1300 | 730 | 3.2 | 400 |
| 7 | 5 | 32 | Ti→Al→Ca | 125 | 1300 | 900 | 3.5 | 100 |
| 8 | 5 | 40 | Ca→Ti→Al | 125 | 1300 | 900 | 3.2 | 400 |
| 9 | 5 | 40 | Ti→Al→Ca | 125 | 1300 | 900 | 3.5 | 720 |
| 10 | 6 | 88 | Ti→Al→Ca | 125 | 1300 | 900 | 3.2 | 350 |
| 11 | 7 | 43 | Ti→Al→Ca | 100 | 1200 | 900 | 4.0 | 310 |
| 12 | 8 | 47 | Ti→Al→Ca | 125 | 1300 | 900 | 3.0 | 400 |
| 13 | 9 | 89 | Ti→Al→Ca | 100 | 1200 | 900 | 4.0 | 400 |
| 14 | 10 | 48 | Ti→Al→Ca | 125 | 1150 | 850 | 2.7 | 650 |
| 15 | 10 | 44 | Ti→Al→Ca | 125 | 1150 | 720 | 3.0 | 400 |
| 16 | 10 | 80 | Ti→Al→Ca | 125 | 1150 | 850 | 3.6 | 210 |
| 17 | 10 | 134 | Ti→Al→Ca | 125 | 1150 | 850 | 2.8 | 650 |
| 18 | 11 | 32 | Ti→Al→Ca | 125 | 1150 | 850 | 3.1 | 400 |
| 19 | 12 | 30 | Ti→Al→Ca | 125 | 1100 | 820 | 2.9 | 400 |
| 20 | 13 | 64 | Ti→Al→Ca | 125 | 1100 | 820 | 3.0 | 400 |
| 21 | 14 | 51 | Ti→Al→Ca | 125 | 1300 | 900 | 3.0 | 420 |
| 22 | 15 | 75 | Ti→Al→Ca | 140 | 1300 | 950 | 2.6 | 420 |
| 23 | 16 | 35 | Ti→Al→Ca | 140 | 1300 | 950 | 2.6 | 450 |
| 24 | 17 | 70 | Ti→Al→Ca | 150 | 1350 | 950 | 2.4 | 450 |
| 25 | 18 | 72 | Ti→Al→Ca | 125 | 1300 | 900 | 3.0 | 400 |
| 26 | 19 | 72 | Ti→Al→Ca | 125 | 1300 | 900 | 3.0 | 400 |
| 27 | 20 | 34 | Ti→Al→Ca | 125 | 1300 | 920 | 3.0 | 400 |
| 28 | 21 | 71 | Ti→Al→Ca | 125 | 1300 | 920 | 3.0 | 400 |

TABLE 2-continued

| PRODUCTION No. | COMPONENT No. | BEFORE DEOXIDATION MOLTEN STEEL OXYGEN AMOUNT ppm | ADDITION ORDER OF Ti, AL, and Ca | FLANGE THICKNESS mm | HEATING TEMPERATURE ° C. | FINISH ROLLING ° C. | COOLING RATE ° C./s | RECUPERATING TEMPERATURE ° C. |
|---|---|---|---|---|---|---|---|---|
| 29 | 22 | 46 | Ti→Al→Ca | 125 | 1300 | 900 | 2.8 | 500 |
| 30 | 23 | 70 | Ti→Al→Ca | 125 | 1300 | 900 | 2.7 | 600 |
| 31 | 24 | 31 | Ti→Al→Ca | 125 | 1300 | 900 | 2.7 | 600 |
| 32 | 25 | 37 | Ti→Al→Ca | 125 | 1300 | 900 | 2.9 | 550 |
| 33 | 26 | 68 | Ti→Al | 125 | 1300 | 920 | 2.9 | 550 |
| 34 | 27 | 54 | Ti→Al→Ca | 125 | 1300 | 920 | 3.0 | 400 |
| 35 | 28 | 59 | Ti→Al→Ca | 125 | 1300 | 900 | 3.0 | 400 |
| 36 | 29 | 84 | Ti→Al→Ca | 125 | 1300 | 900 | 3.0 | 400 |
| 37 | 30 | 61 | Ti→Al→Ca | 125 | 1300 | 900 | 3.0 | 400 |
| 38 | 31 | 57 | Ti→Al→Ca | 125 | 1300 | 900 | 3.0 | 400 |
| 39 | 32 | 42 | Ti→Al→Ca | 125 | 1300 | 900 | 3.0 | 600 |
| 40 | 33 | 33 | Ti→Al→Ca | 125 | 1300 | 900 | 3.0 | 600 |
| 41 | 34 | 50 | Ti→Al→Ca | 125 | 1300 | 900 | 3.0 | 600 |
| 42 | 35 | 71 | Ti→Al→Ca | 125 | 1300 | 900 | 3.0 | 600 |

THE UNDERLINED MEANS THAT THE VALUE IS OUT OF THE RANGE DEFINED IN THE PRESENT INVENTION.

TABLE 3

| PRODUCTION No. | BAINITE FRACTION % | AUSTENITE GRAIN SIZE μm | OXIDE COMPOSITION Ca mass % | OXIDE COMPOSITION Al mass % | OXIDE DENSITY PIESES/ $mm^2$ | YS MPa | TS MPa | $vE_{21}$ ° C. J | REMARKS |
|---|---|---|---|---|---|---|---|---|---|
| 1 | 90 | 195 | 76 | 21 | 521 | 458 | 628 | 187 | EXAMPLE |
| 2 | 92 | 147 | 82 | 10 | 349 | 458 | 648 | 186 | EXAMPLE |
| 3 | 94 | 182 | 80 | 12 | 802 | 467 | 661 | 220 | EXAMPLE |
| 4 | 94 | 161 | 79 | 20 | 771 | 520 | 728 | 220 | EXAMPLE |
| 5 | 88 | 166 | 22 | 61 | 1424 | 471 | 673 | 210 | EXAMPLE |
| 6 | 60 | 134 | 71 | 22 | 1350 | 421 | 565 | 179 | COMPARATIVE EXAMPLE |
| 7 | 82 | 166 | 25 | 70 | 1577 | 470 | 650 | 104 | EXAMPLE |
| 8 | 86 | 283 | 94 | 3 | 79 | 488 | 661 | 72 | COMPARATIVE EXAMPLE |
| 9 | 75 | 171 | 76 | 22 | 1020 | 414 | 522 | 229 | COMPARATIVE EXAMPLE |
| 10 | 83 | 140 | 48 | 20 | 214 | 465 | 866 | 213 | EXAMPLE |
| 11 | 85 | 141 | 51 | 44 | 371 | 460 | 657 | 205 | EXAMPLE |
| 12 | 80 | 198 | 76 | 13 | 189 | 473 | 660 | 184 | EXAMPLE |
| 13 | 90 | 151 | 13 | 85 | 127 | 469 | 638 | 197 | EXAMPLE |
| 14 | 92 | 155 | 50 | 49 | 443 | 472 | 673 | 206 | EXAMPLE |
| 15 | 55 | 110 | 13 | 53 | 400 | 411 | 638 | 200 | COMPARATIVE EXAMPLE |
| 16 | 84 | 187 | 9 | 83 | 487 | 469 | 689 | 105 | EXAMPLE |
| 17 | 93 | 310 | 50 | 44 | 73 | 461 | 641 | 90 | COMPARATIVE EXAMPLE |
| 18 | 94 | 180 | 75 | 24 | 402 | 470 | 670 | 205 | EXAMPLE |
| 19 | 82 | 155 | 23 | 71 | 2016 | 480 | 686 | 183 | EXAMPLE |
| 20 | 88 | 152 | 29 | 31 | 129 | 479 | 648 | 214 | EXAMPLE |
| 21 | 95 | 198 | 80 | 7 | 154 | 487 | 697 | 202 | EXAMPLE |
| 22 | 82 | 142 | 16 | 83 | 505 | 455 | 624 | 188 | EXAMPLE |
| 23 | 82 | 140 | 82 | 12 | 488 | 461 | 620 | 220 | EXAMPLE |
| 24 | 96 | 169 | 30 | 37 | 249 | 508 | 706 | 184 | EXAMPLE |
| 25 | 97 | 158 | 11 | 69 | 419 | 520 | 709 | 49 | COMPARATIVE EXAMPLE |
| 26 | 77 | 178 | 59 | 30 | 556 | 408 | 558 | 111 | COMPARATIVE EXAMPLE |
| 27 | 91 | 144 | 76 | 15 | 330 | 480 | 687 | 29 | COMPARATIVE EXAMPLE |
| 28 | 98 | 198 | 10 | 59 | 685 | 520 | 706 | 31 | COMPARATIVE EXAMPLE |
| 29 | 69 | 176 | 80 | 13 | 539 | 411 | 558 | 136 | COMPARATIVE EXAMPLE |
| 30 | 81 | 198 | 16 | 69 | 687 | 500 | 709 | 87 | COMPARATIVE EXAMPLE |
| 31 | 94 | 290 | 8 | 70 | 88 | 471 | 647 | 69 | COMPARATIVE EXAMPLE |
| 32 | 93 | 322 | 18 | 81 | 52 | 474 | 642 | 61 | COMPARATIVE EXAMPLE |

TABLE 3-continued

| PRODUCTION No. | BAINITE FRACTION % | AUSTENITE GRAIN SIZE μm | OXIDE COMPOSITION Ca mass % | OXIDE COMPOSITION Al mass % | OXIDE DENSITY PIESES/ $mm^2$ | YS MPa | TS MPa | $vE_{21}$ ° C. J | REMARKS |
|---|---|---|---|---|---|---|---|---|---|
| 33 | 92 | 302 | 0 | 80 | 71 | 475 | 647 | 50 | COMPARATIVE EXAMPLE |
| 34 | 94 | 174 | 69 | 30 | 530 | 522 | 744 | 35 | COMPARATIVE EXAMPLE |
| 35 | 96 | 140 | 79 | 12 | 303 | 487 | 684 | 21 | COMPARATIVE EXAMPLE |
| 36 | 94 | 146 | 33 | 65 | 338 | 497 | 675 | 49 | COMPARATIVE EXAMPLE |
| 37 | 95 | 200 | 62 | 21 | 700 | 479 | 684 | 34 | COMPARATIVE EXAMPLE |
| 38 | 92 | 160 | 8 | 59 | 436 | 469 | 632 | 74 | COMPARATIVE EXAMPLE |
| 39 | 97 | 197 | 12 | 66 | 468 | 570 | 781 | 65 | COMPARATIVE EXAMPLE |
| 40 | 61 | 167 | 75 | 20 | 681 | 398 | 533 | 216 | COMPARATIVE EXAMPLE |
| 41 | 82 | 180 | 60 | 37 | 299 | 389 | 540 | 288 | COMPARATIVE EXAMPLE |
| 42 | 84 | 175 | 55 | 40 | 402 | 378 | 539 | 276 | COMPARATIVE EXAMPLE |

THE UNDERLINED MEANS THAT THE VALUE IS OUT OF THE RANGE DEFINED IN THE PRESENT INVENTION.

Figure 2:
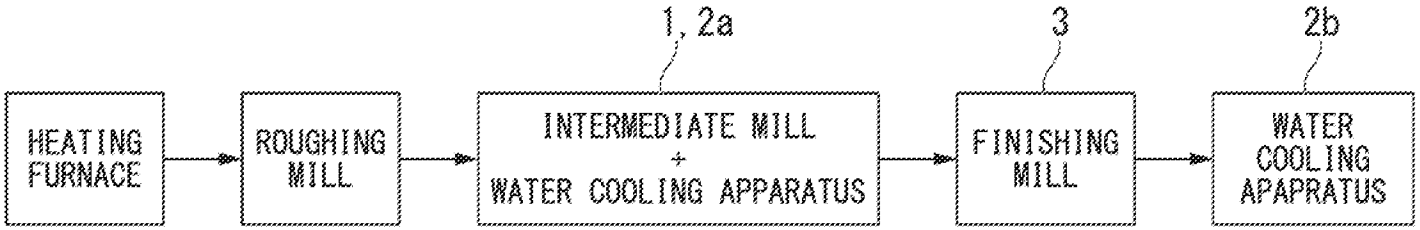
FIG. 2 is a view illustrating an example of an apparatus for producing the H-section steel according to the embodiment.

The process for producing the H-section steel is illustrated in FIG. 2. The hot rolling (rough rolling, intermediate rolling, and finish rolling) was performed by a universal rolling apparatus line. When the hot rolling was subjected to interpass water cooling rolling, reverse rolling was performed while the flange outer surface was spray-cooled using water cooling devices 2*a* provided on front and rear surfaces of an intermediate universal mill (intermediate mill) 1 in the water cooling between rolling passes. Finish rolling was performed using a finish universal mill (finishing mill) 3 and then water cooling after the controlled rolling was performed by a cooling device (water cooling device) 2*b* arranged on the rear surface of the finishing mill 3 to water-cool the flange outer surface.

The amount of oxygen (ppm) in the molten steel before deoxidation treatment is performed (before Ti is added), the addition order of Ti, Ca, and Al, and the hot rolling condition (production condition) are shown in Table 2. The cooling rate in Table 2 is a value at a ⅙ position from the surface of the flange in the length direction and a ¼ position from the surface of the flange in the thickness direction. However, the cooling rate is not directly measured and is a value calculated from the water cooling start temperature and the water cooling stop temperature and the application time based on the result obtained by measuring the cooling rate of the accelerated cooling by attaching a thermocouple to the corresponding portion and the prediction obtained by computer simulation when an examination in which a separately embodied steel having the same size is heated off-line and acceleratedly cooled is performed.

A sample used in a tensile test and measurement of the bainite fraction was taken from the strength evaluation position 7 shown in FIG. 1. The sample was used for evaluating the yield strength and the tensile strength and measuring the bainite fraction. In addition, a sample used in a Charpy test and measurement of the austenite grain size was taken from the toughness evaluation position 8 shown in FIG. 1. The sample was used for evaluating the toughness and measuring the austenite grain size. t1 represents the thickness of the web, t2 represents the thickness of the flange, F represents the length of the flange, and H represents the height.

The tensile test was performed according to JIS Z 2241 to obtain YS and TS. Here, YS was defined as a yield point when representing yield behavior and was defined as 0.2% proof stress when not representing yield behavior. The Charpy impact test was performed at a test temperature of 21° C. according to JIS Z 2242, Further, the metallographic structure was observed with an optical microscope or EBSP and the austenite grain size and the area fraction of bainite were measured. In addition, the kind of the balance structure was specified. Furthermore, an extraction replica was prepared and the number density and the composition of the oxide particles were obtained by an electron microscope and EDS. The oxide composition shown in Table 3 is a ratio of Ca and Al excluding oxygen and the balance is Ti. The sampling position of the extraction replica is the same position as the toughness evaluation position 8 shown in FIG. 1.

The mechanical test results and the structure observation results are shown in Table 3. YS in Table 3 represents a yield point or 0.2% proof stress at room temperature. The target values of the mechanical properties are a yield strength at room temperature or 0.2% proof stress (YS) of 450 MPa or more and a tensile strength (TS) of 550 MPa or more. In addition, the target value of the Charpy absorbed energy at 21° C. (vE21) is 100 J or more.

As shown in Table 3, in Production Nos. 1 to 5, 7, 10 to 14, 16, and 18 to 24, which are examples of the present invention, the bainite fraction, the austenite grain size, the oxide composition, and the oxide density were within preferable ranges. As a result, YS and TS respectively satisfied values of 450 MPa or more and 550 MPa or more, which were the target lower limits. Further, the Charpy absorbed energy at 21° C. was 100 J or more, which was enough to satisfy the target value.

As shown in Tables 2 and 3, in Production Nos. 7 and 15, the recuperating temperature is lower than 300° C. and the self tempering effect is small. Therefore, while the Charpy absorbed energy is 100 J or more, the value was relatively low-compared to other steels.

On the other hand, in Production Nos. 6, 8, 9, 15, 17, and 25 to 42 shown in Table 3, at least one of the chemical composition, the production method, the bainite fraction, the austenite grain size, and the oxide density were out of the range of the present invention and all of YS, TS, or the toughness did not satisfy the above-described target values.

Production No. 8 is an example in which the addition order of deoxidizing agents is changed. In Production No. 8 in which Al was finally added, the ratio of Al in the oxide composition was lowered.

Production No. 17 is an example in which the molten steel oxygen amount before deoxidization is high. In Production No. 17, the austenite grain size and the oxide density were out of the range of the present invention.

Production No. 33 is an example in which Ca is not added as a deoxidizing agent and Ca is not contained in the oxide composition.

INDUSTRIAL APPLICABILITY

The H-section steel of the present invention can be produced without requiring a large amount of an alloy to be contained and performing ultra-low-carbonization in which a steel production load is large. Therefore, a remarkable cost reduction resulting from a production cost reduction and shortening of the period of time for work can be promoted. In addition, the H-section steel of the present invention is a high-strength ultra-thick H-section steel having excellent toughness. Accordingly, the steel remarkably contributes to the industry such that the reliability of a large building structure can be improved without impairing economic efficiency.

BRIEF DESCRIPTION OF THE REFERENCE SYMBOLS

1: INTERMEDIATE MILL
2*a*: WATER COOLING APPARATUS ON FRONT AND REAR SURFACES OF INTERMEDIATE MILE
2*b*: COOLING DEVICE ON REAR SURFACE OF FINISHING MILL
3: FINISHING MILL
4: H-SECTION STEEL
5: FLANGE
6: WEB
7: STRENGTH EVALUATION POSITION
8: TOUGHNESS EVALUATION POSITION
F: TOTAL FLANGE LENGTH
H: HEIGHT
t1: THICKNESS OF WEB
t2: THICKNESS OF FLANGE

The invention claimed is:

1. An H-section steel comprising:
a flange; and
a web,
wherein the steel includes, as a chemical composition, by mass %,
C: 0.05% to 0.16%,
Si: 0.01% to 0.50%,
Mn: 0.80% to 2.00%,
Ni: 0.05% to 0.50%,
V: 0.01% to 0.20%,
Al: 0.005% to 0.100%,
Ti: 0.005% to 0.030%,
N: 0.0010% to 0.0200%,
O: 0.0001% to 0.0100%,
Ca: 0.0003% to 0.0040%,
Cr: 0% to 0.50%,
Cu: 0% to 0.50%,
Mo: 0% to 0.20%,
Nb: 0% to 0.05%, and
a balance consisting of Fe and impurities,
a carbon equivalent Ceq obtained by the following expression (1) is 0.35% to 0.50%,
a number density of oxide particles having an equivalent circle diameter of 0.005 μm to 2.0 μm per unit area is 100 pieces/mm$^2$ to 5000 pieces/mm$^2$,
the oxide particle includes Ca, Al, and O as a composition,
an amount of Ca is 5% or more, an amount of Al is 5% or more, and a total amount of Ca and Al is 50% or more by mass ratio excluding O in the oxide particle,
a thickness of the flange is 100 mm to 150 mm,
a bainite fraction in a metallographic structure of the flange is 80% or more at a strength evaluation position which is a ⅙ position from a surface of the flange in a length direction and is a ¼ position from the surface of the flange in a thickness direction, and
an average prior austenite grain size in the metallographic structure of the flange is 200 μm or less at a toughness evaluation position which is a ½ position from the surface of the flange in the length direction and is a ¾ position from the surface of the flange in the thickness direction, $$Ceq=C+Mn/6+(Cr+Mo+V)/5+(Ni+Cu)/15 \quad \text{Expression (1),}$$

here, C, Mn, Cr, Mo, V, Ni, and Cu in the expression represent an amount (mass %) of each element, and elements which are not added are indicated as 0.

2. The H-section steel according to claim 1,
wherein, the steel includes as a chemical composition, by mass %:
Cr: 0.01% to 0.50%;
Cu: 0.01% to 0.50%;
Mo: 0.001% to 0.20%; and
Nb: 0.001% to 0.05%.

3. The H-section steel according to claim 1,
wherein a yield strength or a 0.2% proof stress is 450 MPa or more, a tensile strength is 550 MPa or more, and a Charpy absorbed energy at 21° C. is 100 J or more at the strength evaluation position.

4. The H-section steel according to claim 1, wherein the oxide particle contains Ti.

5. The H-section steel according to claim 1, wherein the steel is produced by universal rolling.

6. The H-section steel according to claim 2,
wherein a yield strength or a 0.2% proof stress is 450 MPa or more, a tensile strength is 550 MPa or more, and a Charpy absorbed energy at 21° C. is 100 J or more at the strength evaluation position.

7. The H-section steel according to claim 2, wherein the oxide particle contains Ti.

8. The H-section steel according to claim 3, wherein the oxide particle contains Ti.

9. The H-section steel according to claim 6, wherein the oxide particle contains Ti.

10. The H-section steel according to claim 2, wherein the steel is produced by universal rolling.

11. The H-section steel according to claim 3, wherein the steel is produced by universal rolling.

12. The H-section steel according to claim 4, wherein the steel is produced by universal rolling.

13. The H-section steel according to claim 6, wherein the steel is produced by universal rolling.

14. The H-section steel according to claim 7, wherein the steel is produced by universal rolling.

15. The H-section steel according to claim 8, wherein the steel is produced by universal rolling.

16. The H-section steel according to claim 9, wherein the steel is produced by universal rolling.

* * * * *